US005725436A

United States Patent [19]

Miller et al.

[11] Patent Number: 5,725,436

[45] Date of Patent: Mar. 10, 1998

[54] BILLIARD CUE STICK EXTENSION

[76] Inventors: Cathy Miller, P.O. Box 1036, Grantsville, Utah 84029; Michial E. Miller, 250 E. Winslow Ave., #C, Salt Lake City, Utah 84029

[21] Appl. No.: 633,872

[22] Filed: Mar. 6, 1996

Related U.S. Application Data

[63] Continuation-in-part of Ser. No. 17,047, Jan. 4, 1994, abandoned.

[51] Int. Cl.[6] ..... A63D 15/08

[52] U.S. Cl. ..... 473/46; 473/48

[58] Field of Search ..... 473/48, 49, 44

[56] References Cited

U.S. PATENT DOCUMENTS

| | | | |
|---|---|---|---|
| 591,487 | 10/1897 | Muller . | |
| 644,681 | 3/1900 | Page . | |
| 1,101,023 | 6/1914 | Gorsuch . | |
| 1,605,240 | 11/1926 | Johnson | 473/49 |
| 2,694,661 | 11/1954 | Meyer . | |
| 3,103,359 | 9/1963 | Gentile, Jr. . | |
| 3,436,079 | 4/1969 | Berry et al. . | |

FOREIGN PATENT DOCUMENTS

| | | | |
|---|---|---|---|
| 2160784 | 1/1986 | United Kingdom | 473/48 |
| 2172210 | 9/1986 | United Kingdom | 473/48 |
| 2191954 | 12/1987 | United Kingdom | 473/48 |

*Primary Examiner*—Mark S. Graham

*Attorney, Agent, or Firm*—Thorpe, North & Western, L.L.P.

[57] ABSTRACT

A billiard cue stick extension comprises a shaft and an elongate rod. The shaft defines an elongate cavity which is open at one end to receive a cue stick. The other end of the shaft is combined with an elongate rod which effectively extends the length of the cue. The Shaft is made of a soft resilient material to friction-fit with the cue stick without marring it. The shaft is hollow and is made of a fiber reinforced plastic to emulate the performance of a cue stick without adding substantial weight to it.

12 Claims, 2 Drawing Sheets

BILLIARD CUE STICK EXTENSION

This is a continuation-in-part of U.S. patent application Ser. No. 29/017,047, filed Jan. 4, 1994, abandoned, entitled BILLIARD CUE EXTENSION TIP.

BACKGROUND OF THE INVENTION

This invention relates to a billiard cue extension which is easily fastened to and released from the tip-end of a billiard cue stick to extend its effective length without disrupting its feel and balance.

A cue stick is essential equipment used to project the cue ball into other balls in the game of billiards (which will be used interchangeably herein with "pool", "pocket billiards" and the variety of similar games). One's skill in the game is to a great degree a function of the effective manipulation of the cue stick in a complex manner to project the cue ball in complex trajectories. This involves such factors as the angle speed, angular momentum and mass of the cue stick.

An important factor of the game is the geometry of the table upon which the game is played in relation to the combined size of the cue stick and the player. A player must be able to effectively place the end of the cue stick at the cue ball at the right angle, speed etc. without climbing upon the table or moving or obstructing the game. Manipulation of the cue is normally accomplished by resting the tip-end of the cue in a an arch made by one hand (the "bridge") and moving the cue stick with the other. In order to accomplish this basic function, the "bridge" hand must be placed in proximity to the cue stick tip, and, consequently, the cue ball.

The largest of these tables is approximately 2 meters by 3.5 meters in a horizontal plane and 1 meter off the floor. It has long been appreciated that a player is unable to present the tip of the cue stick and the bridge hand at any of the universe of possible locations at any desired angle, without climbing upon the table (which generally would violate the operative rules). This is a particular disadvantage to smaller players.

In order to overcome these limitations and disadvantages, a "fixed bridge" has been used comprising a stick with a notched end. Using the stick, the player places the fixed bridge on the table with the notched end in the out-of-reach location where the needed bridge must be formed. The tip-end of the cue stick is placed on the fixed bridge while the player manipulates the stick to make the shot.

There are distinct disadvantages to fixed bridges. First, the notch is not infinitely variable (within a range) in height and other dimensions as is a normal bridge formed by the hand of the player. There are only as many options as notches. Secondly, the cue stick in such an operation is more distant from the player. The player must therefore change the relationship of the stick to the body and the kinesthetic relationships of involved muscles, tendons bones, joints etc. In essence, the player must abandon the known and familiar process and adopt a completely unknown process relative to manipulation of the cue stick.

Attempts have also been made to change the dimensions of the cue stick by adding extensions thereto at one end or by inserting a middle extension. This results in changing the balance and weight of the cue stick so as to also necessitate abandonment of the known and familiar process used by the player in conjunction with a normal shot.

SUMMARY OF THE INVENTION

It is an object of the invention to provide a billiard cue stick extension which frictionally fits on the end of a cue stick without changing the performance characteristics or marring the cue stick.

It is a further object of the invention to provide such a billiard cue stick extension which will not warp.

The above and other objects of the invention are realized in a specific illustrative embodiment of a billiard cue stick extension having a shaft and an elongate rod. The shaft defines an elongate cavity which is open at one end to receive a cue stick. The other end of the shaft is combined with an elongate rod which effectively extends the length of the cue. The Shaft is made of a soft, resilient material to friction-fit with the cue stick without marring it. The shaft is hollow and is made of a fiber reinforced plastic to emulate the performance of a cue stick without adding substantial weight and to resist warping.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION OF THE DRAWINGS

Figure 1:
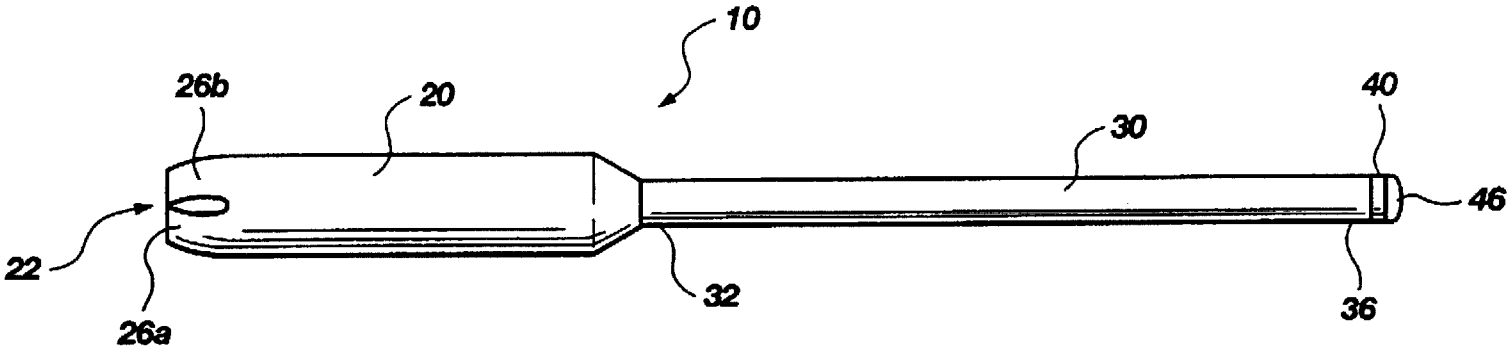
FIG. 1 is a side view of a billiard cue stick extension, made in accordance with the principles of the present invention.
Figure 2:
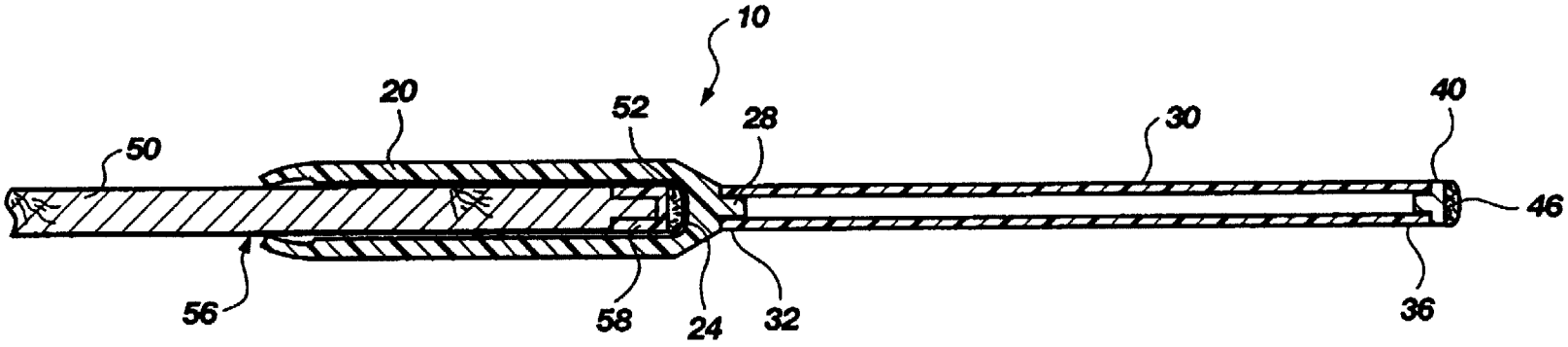
FIG. 2 is side, cross-sectional view of the billiard cue stick extension of FIG. 1 with a fragmented side cross sectional view of a billiard cue stick inserted therein.

Referring to FIGS. 1 and 2, wherein like numbers are used to indicate like structure, there is shown generally at 10 a billiard cue stick extension. The billiard cue extension is comprised of two major components, a shaft 20 and an elongate rod 30. As shown most clearly in FIG. 2, the shaft defines an inner diameter and an elongate cavity (not numbered) therein. The cavity is open at one end of the shaft which forms an aperture 22 to the cavity. At an opposing end of the cavity there is formed in the shaft a cavity bottom 24 (FIG. 2).

Integrally formed in the shaft at the aperture end are a number of fingers **26*a* and 26*b* formed integrally in the shaft. The fingers are fashioned by cutting slits in the shaft. The fingers 26*a* and 26*b*** are bent toward the aperture for reasons that are explained later herein.

At the opposing end of the shaft from the aperture 22 is a projection 28.

The shaft 20 is formed from injection molded plastic, typically acrylonitrile butadiene styrene. Such material is light weight, easy to form into the desired shape and is resilient enough to friction fit with a cue stick as is later described herein. It is also of a hardness less than the typical finishes and materials used for cue sticks, and will therefore not mar them. It will be appreciated that any material of similar performance characteristics may be used.

The elongate rod 30 is a hollow shaft formed from fiber reinforced plastic. Such fiber reinforcement is not suitable for the shaft 20, but is necessary to the rod 30 to stiffen it and to prevent warping. This material maintains the expected performance of the cue stick without affecting its balance. The fibrous fill material is graphite fibers. It will be appreciated that glass fibers or wound glass, graphite, aramid or other known fibers could be used to stiffen the rod without adding significant weight while also preventing warping.

The hollow end 32 of the elongate rod 30 is attached to the projection 28 of the shaft 20. The projection has an outside diameter similar to the inside diameter of the end 32. This is accomplished by means known in the art such as by gluing the pieces.

A tip is attached to an opposing end 36, of the rod 30. The tip comprises a plug 40 which has a flat portion and a projection which is fixed in the second end 36 of the rod 30, such as by gluing. A typical leather bud 46 (one of which is used to form the tip of the cue stick as well) is glued to the flat portion of the plug 40.

All of the materials used to form the inventive billiard cue stick extension described herein are light weight so as to minimize any change in the performance characteristics of the cue stick to which it is attached. Because the billiard cue stick extension is light weight, the balance and expected performance of the cue stick will be maintained upon employment of the inventive device.

A cue stick 50 (FIG. 2) is inserted into the cavity of the shaft. The cue stick frictionally fits at basically two points, the aperture 22 formed by the fingers 26*a* and 26*b* at the second end of the shaft, and the cavity bottom 24. The tip 52 of the cue stick 50 engages the bottom 24, and the shank 56 of the stick 50 is engaged by the fingers 26*a* and 26*b*. It is important that the shaft of the cue stick 50 is not engaged by a significant portion of the cavity. The ferrule 58 of the cue stick is vulnerable to inadvertent removal if there is too much friction in this area.

The cue stick 50 is normally used until an anticipated shot requires an extension. When that eventuality arises, the billiard cue stick extension 10 is fitted to the cue stick 50, by sliding the end of the stick into the cavity until the tip of the cue stick engages the bottom 24 of the chamber. Because of the light weight of the device, the balance of the cue stick is maintained. The player's hold of the stick 50 is also maintained. The only significant difference is that the player must calculate that the effective length of the cue stick is lengthened. Billiards is, however, a game of angles and distances and these adjustments come naturally.

Figure 3:
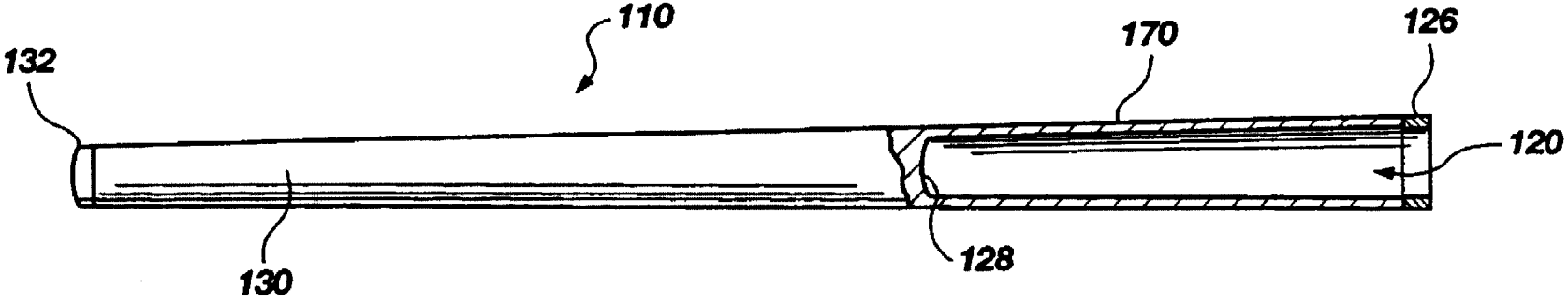
FIG. 3 is a partially cut away side view of another preferred embodiment of a billiard cue stick extension made in accordance with the principles of the present invention.

Turning now to FIG. 3, wherein a second preferred embodiment of a billiard cue extension 110 is disclosed, a shaft is depicted generally at 120. The shaft 120 defines therein a cavity 124 for receiving a billiard cue stick (not depicted. The cavity 124 is generally the shape of the tip-end of a billiard cue stick, but of a slightly larger dimension to receive the same. The aperture 126 of the cavity 124 is formed from the end of the shaft 120. The portion of the shaft 120 defining the aperture 126 is made of a resilient material so as to frictionally fit with the circumference of the cue stick. When the cue stick is inserted in the cavity 124, it is held in place preferably by the resilient material and the bottom of the chamber 128, the tip of the cue stick residing against the bottom 128.

The cue stick extension also comprises an elongate rod portion 130 extending from the shaft 120 away from the cavity 124. The rod portion 130 and the chamber 124 have the same central axis. Thus, when a cue stick is inserted in the cavity it is in alignment with the rod 130. This provides for correct alignment and feel when presenting the cue stick/extension combination for play.

A tip 132 is presented on the end of the rod 130 opposite the shaft 120. The tip 132 is one suitable for properly impacting a billiard ball during play. It will be appreciated that the tip may be attached as above-described, or it may be attached in a conventional manner.

The cue stick extension 110 is made of light weight material which is capable of manufacture in true shape, and which also resists warping. The light weight and true aspects are described hereinbefore. It has ben found that unitary manufacture of the invention of acrylonitrile butadiene styrene is acceptable. This material is light and generally true. The cue stick extension 110 may also be manufactured of a shaft region 120 made of acrylonitrile butadiene styrene, and a rod region 130 of fiber filled plastic as set forth above.

The embodiments of the invention described herein are only examples of how the invention may be applied to specific devices. Modifications and variations of, for example, materials used, sizes and shapes of components, and equivalent structures will be apparent to those skilled in the art while remaining within the scope of the invention.

What is claimed is:

1. A billiard cue stick extension comprising a shaft defining an inner diameter and an internal cavity adapted for frictionally and releasably receiving the tip of a billiard cue stick, an elongate rod for increasing the effective length of the cue stick, said rod extending from the shaft such that the rod and the billiard cue stick have the same central axis when the cue stick is inserted in the cavity, and a tip on an end of the rod opposite the shaft, said tip for impacting a billiard ball;

wherein the shaft further comprises a first end defining a bottom to the cavity and an opposing second end, said shaft tapering radially inwardly toward the second end to define an aperture to the cavity such that the shaft frictionally engages the billiard cue stick at the bottom and at the aperture without engaging said billiard cue stick along a substantial portion of the shaft between said bottom and said aperture.

2. A billiard cue stick extension as in claim 1, wherein the shaft further comprises a plurality of resilient fingers extending radially inwardly toward the second end such that said fingers collectively define the aperture to the cavity.

3. A billiard cue stick extension comprising a shaft and an elongate rod, said shaft defining an elongate cavity therein, having first and second ends, being closed at the first end, open at the second end, and wherein said shaft defines an aperture at said open second end, said shaft adapted to be releasably engageable to a billiard cue stick having a tip and a shank such that when the billiard cue stick is inserted in the cavity, the closed first end frictionally engages the tip and the open second end defining the aperture frictionally engages the shank, without the shaft engaging said billiard cue stick along a substantial portion of the shaft between said closed first end and said open second end, and the elongate rod having first and second ends and a second tip for engaging a cue ball, said first end of the rod fixed to the first end of the shaft and said second tip fixed to said second end of the rod.

4. The billiard cue stick extension of claim 3 wherein the shaft is injection molded plastic of a hardness of less than the hardness of the billiard cue stick.

5. A billiard cue stick extension as in claim 4 wherein said injection molded plastic is acrylonitrile butadiene styrene.

6. A billiard cue stick extension as in claim 3 wherein the elongate rod is fiber reinforced plastic.

7. A billiard cue stick extension as in claim 6 wherein the fiber is graphite.

8. A billiard cue stick extension as in claim 3 wherein the shaft comprises acrylonitrile butadiene styrene and the elongate rod comprises fiber reinforced plastic.

9. A billiard cue stick extension as in claim 3 wherein said aperture comprises a plurality of fingers bent toward the aperture.

10. A billiard cue stick extension as in claim 3 wherein the elongate rod is hollow at the first end forming an inside dimension and said first end of the shaft further comprises a projection with an outside dimension smaller and complementary to the inside dimension of the first end of the elongate rod, said first end of the rod fitted to the first end of the shaft.

11. A billiard cue stick extension comprising: a shaft of acrylonitrile butadiene styrene, said shaft having first and second ends and an elongate cavity in the second end for receiving a cue stick;

an elongate rod of fiber reinforced plastic joined at a first end to the first end of the shaft and joined at a second end to a tip for engaging a billiard ball;

said elongate cavity further comprising an aperture circumscribed by the second end of the shaft and an aperture bottom, such that the second end of the shaft is releasably engageable to a shank of a billiard cue stick inserted in the cavity and the bottom is releasable engageable to a tip of a billiard cue inserted in the cavity;

wherein said billiard cue stick substantially frictionally engages the shaft only at the second end of the shaft and the bottom of the cavity.

12. A billiard cue stick extension as in claim 11 wherein said second end of the shaft forms a plurality fingers bent in the direction of the aperture to frictionally engage the cue stick.

* * * * *